US005800237A

United States Patent [19]

Cummings

[11] Patent Number: 5,800,237

[45] Date of Patent: Sep. 1, 1998

[54] FLYING SEGMENTED RING

[76] Inventor: Charles A. Cummings, 5719 Thomaridge Ct., Cincinnati, Ohio 45248

[21] Appl. No.: 799,633

[22] Filed: Feb. 12, 1997

[51] Int. Cl.[6] ..... A63H 27/00

[52] U.S. Cl. ..... 446/48; 473/589

[58] Field of Search ..... 446/46, 47, 48; 473/588, 589, 569

[56] References Cited

U.S. PATENT DOCUMENTS

| | | | |
|---|---|---|---|
| 2,304,215 | 12/1942 | Streubel | 446/48 |
| 2,835,073 | 5/1958 | Dame | 446/48 |
| 4,185,826 | 1/1980 | Ueng | 473/588 |
| 4,246,720 | 1/1981 | Stone | 446/47 |
| 4,747,798 | 5/1988 | Wang et al. | 446/47 |
| 4,944,707 | 7/1990 | Silverglate | 446/48 |
| 4,955,841 | 9/1990 | Pastrano | 446/46 |
| 5,030,157 | 7/1991 | Silverglate | 446/48 |

*Primary Examiner*—Robert A. Hafer
*Assistant Examiner*—D. Neal Muir
*Attorney, Agent, or Firm*—Neal O. Willmann

[57] ABSTRACT

A toy segmented ring suitable for tossing and game playing and having a generally annular shape defined by an augmented perimeter encompassing a plurality of flexible flaps surrounding a central orifice. The flaps will flex in response to lift forces which materialize as the ring is spinning during flight and will billow to provide a parachute effect on descent. These structural features add accuracy, ease of catching and interest to games and activities employing the ring.

4 Claims, 3 Drawing Sheets

FIG. 1
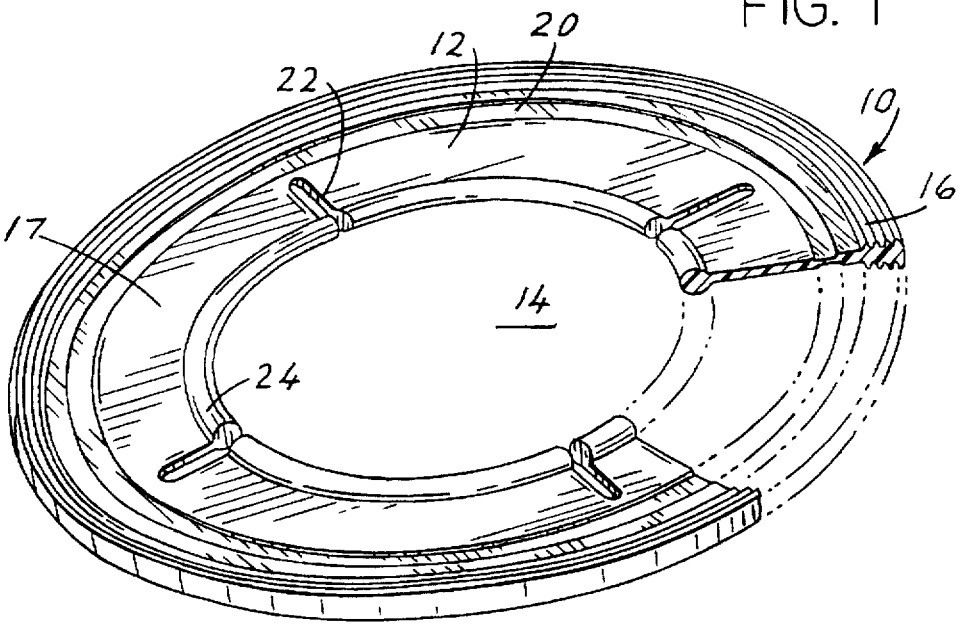
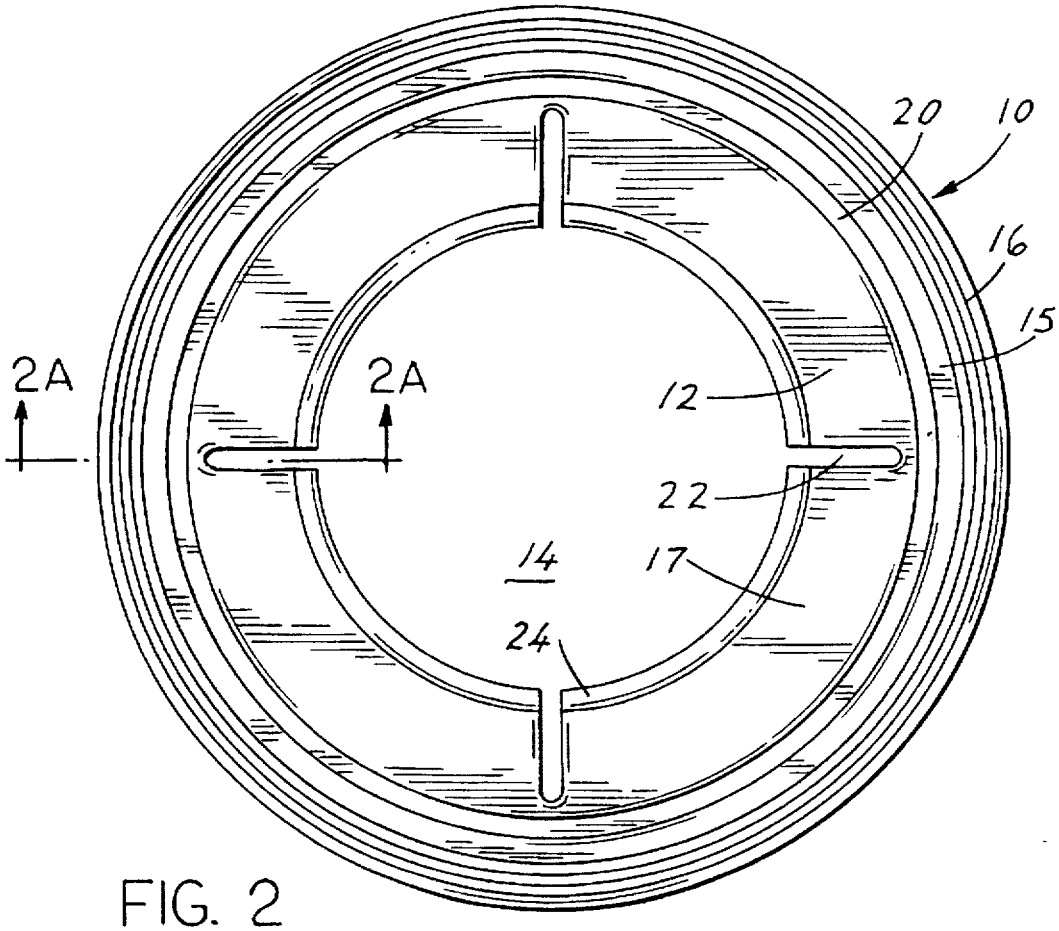
FIG. 2

FLYING SEGMENTED RING

BACKGROUND OF THE INVENTION

This disclosure relates generally to a class of toys that can be tossed with a flick of the wrist to produce a light remarkable for its duration and predictability. The spinning action, generally imparted during launch, and the aerodynamics, usually ascribed to airfoils, typically produce a lift which appears to enhance the glide and flight path of these amusing, and somewhat amazing, aerodynes.

Of course it is readily acknowledged that there is nothing unusual or novel in the idea of tossing an annular disc or ring for fun and amusement. The patent art is replete with disclosures, and most people have had personal experiences with examples of annular discs that can be fashioned from a variety of materials and pitched or tossed from one participant to another, between man and his best friend or at an inanimate target.

Recent examples of such amusing discs include Adler's U.S. Pat. No. 4,560,358 dated Dec. 24, 1985 disclosing a gliding ring toy comprising a closed-figure airfoil with a narrow lip on the outer perimeter to balance the aerodynamic lift, fore and aft, during flight.

U.S. Pat. No. 4,802,030 to Richards also describes a tossing ring with an annular body but featuring a plurality of flat surfaces on the outer surface of the annulus, including flat surfaces on the upper, lower and two side surfaces.

U.S. Pat. No. 4,737,128 to Moormann et al. describes a toy air foil which is circular and flexible, probably due to its elastomeric composition, and which can assume concave and convex orientations depending upon its resting surface.

McFarland, in U.S. Pat. No. 5,078,637, discloses a flexible flying disc with a circular dome which inflates upwardly to provide an air foil effect with alleged aerodynamic benefits.

But, notwithstanding the various features, components and compositions of the discs described in the aforementioned presentation of the prior art, there remains an opportunity to experiment with the features and structural elements of the previously known rings, discs, airfoils and aerodynes to improve upon their flightworthiness, accuracy and amusement value. This is precisely what has been undertaken and the instantly disclosed segmented ring is the product of that experimentation and endeavor.

SUMMARY OF THE INVENTION

Accordingly, then, a toy tossing ring which comprises a structurally augmented perimeter, generally annular in shape, having a plurality of flexible flaps annularly hinged to said perimeter, said flaps defining a central orifice which enlarges during flight by virtue of the lift forces on the flexible flaps of the spinning, sailing ring is disclosed by drawings and elaboration.

BRIEF DESCRIPTION OF THE DRAWINGS

FIG. 1 is an elevated perspective view of the ring.

FIG. 2-A is a partial section of the ring taken along line A-A.

FIG. 3-A depicts a sequence of events illustrating the ring in a (a) launching mode, (b) in flight and (c) in a landing approach.

DESCRIPTION OF THE PREFERRED EMBODIMENT

What is generally disclosed is a toy ring which, because of its shape and size, can be tossed or thrown for sport of amusement with a fair degree of accuracy. The shape of the ring is generally annular, the size being not unlike that of a dinner plate, although a ring that is larger or smaller would probably work, that is to say, sail as well, depending, of course, on the strength of the person launching the ring.

Ideally, the disc is fabricated in a molding operation and is typically molded from one of a variety of thermoplastic materials including polycarbonates, polyvinyls and polyethylenes. Most preferred would be the polyvinyls, which cure to a softer, more elastomeric, ring device which is suitable, even if not permissible, for throwing indoors.

Figure 2A:
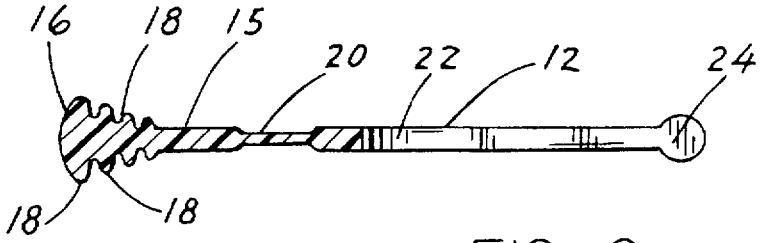
FIG. 2 is a top (or bottom) view of the ring.

Referring to FIG. 1, a preferred embodiment of the disclosed ring is depicted wherein the overall symmetry and annular shape is apparent. In FIG. 2, the elements of the ring 10 are more easily described. For all practical purposes, the ring is defined by its augmented perimeter 16. The perimeter is the primary source of structure for the ring and supports the flaps 12 and the hinge 20. The flaps 12 are ideally segmented, which is to say, they are somewhat separated from each other and can move independently or each other; although, in most instances, they'll be acting in concert; and they are typically of equal size. In flight, see FIGS. 3 and 3-A, the flaps will move on the hinge 20 in a direction perpendicular to the direction of flight and the orifice 14, in the middle of the ring, will increase in size with the spinning and flight speeds of the device. Similarly, during descent, the flaps will move in a direction generally opposite to the ground and flutter to create a parachute effect to soften the landing of the ring.

In FIG. 2-A, a partial cross section of the ring taken along line A—A provides an elaboration of the augmented perimeter 16 of the ring 10. In the preferred embodiment the augmentation is effected by molding segmented annulations 18 which taper down, in size, from the outer annulation to the innermost annulation. The number of annulations can vary, of course, and the degree of taper is primarily a molding or manufacturing concern and has little effect on the aerodynanic properties of the ring.

Ultimately the innermost tapered annulation 18 of the augmented perimeter will taper to the point where rings are imperceptible and the planar surface 15 of the ring begins. The planar surface extends, however, for a relatively short distance before it terminates in the annular hinge 20. The primary purpose of the annular hinge 20 is to flexibly support the plurality of flaps 12 which provide the unique structure and aerodynamic performance of the ring. Typically, the annular hinge 20 will be seen as a flexible webbing. It will be constructed of the same thermoplastic material as the other elements of the ring, but it will be the thinnest and most flexible component of the ring.

Attached to the annular hinge 20 are the flaps. They will also be molded of the same material as the augmented perimeter and the annular hinge, but, in a preferred embodiment, they will be somewhat thicker than the annular hinge 20 and thinner than the segmented annulations 18 of the augmented perimeter.

Figure 3:
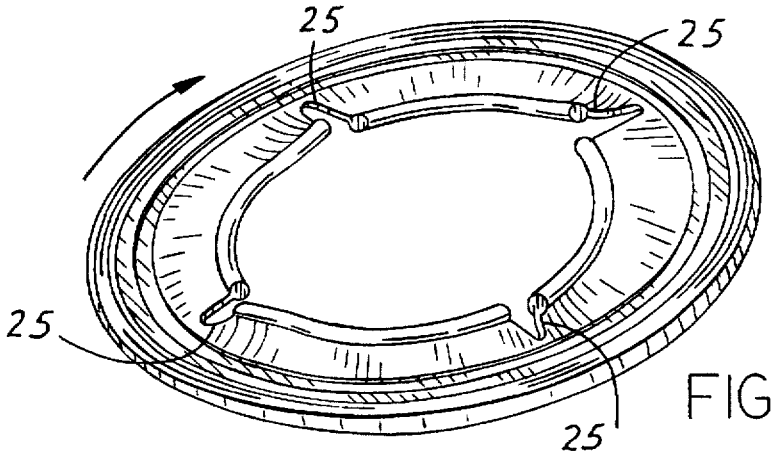
FIG. 3 depicts the "fan blade" configuration created by the spinning ring.
Figure 3A:
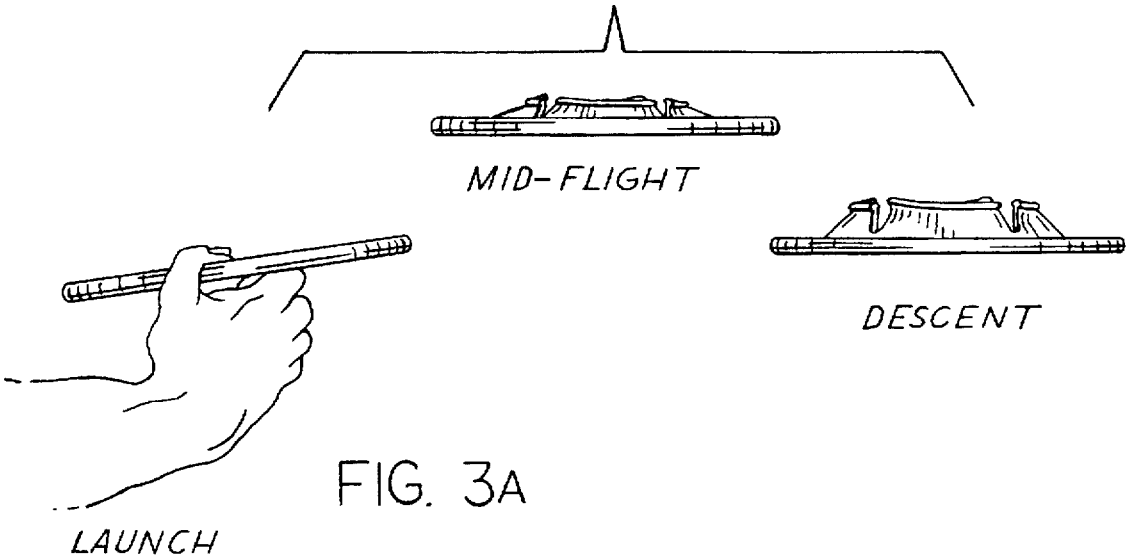

Again, in the preferred embodiment, the flaps will be segments of generally equal size that are cut or molded from the second planar region 17 of the ring. They will be cut from or molded in the second planar region 17 in such a manner so as to create an orifice 14 ideally located in the center of the ring. Characteristically, the orifice 14 in the ring will be enlarged during the flight of the ring as a result of the flexible flaps responding to air pressure, or lift, perpendicular to the direction of flight. Typical flight configurations of the flaps: launch, mid-flight and descent are shown in FIG. 3-A As shown in FIG. 3, the spinning of the ring causes the leading edges 25 of the flaps to be lifted, thus creating lift as the ring flies through the air. And it empirically appears that the greater the flight speed and spin imparted at launch, the greater the lift.

In a preferred embodiment of the toy ring, the inner perimeter of the flaps, which define the orifice, will be reinforced 24 with more of the molded material to better withstand the rigors of wear and tear on the ring as it encircles hands and targets. To facilitate the movement of the flaps, it is preferred that the flaps be cut from or molded in the second planar surface 17. It is preferred that sufficient material will be deleted or removed to form open channels 22 between the flaps thus allowing facile movement of the flaps.

These structural elements: the augmented perimeter, the annular hinge, the central orifice and the flexible flaps all combine and cooperate to create al aerodyne in the shape of a symmetrical ring that will manifest desirable aerodynamic properties. These properties can be exploited to permit safe and accurate ring tossing indoors, especially when the ring is constructed from the thermoplastic polymers that cure to elastomeric softness.

Figure 4:
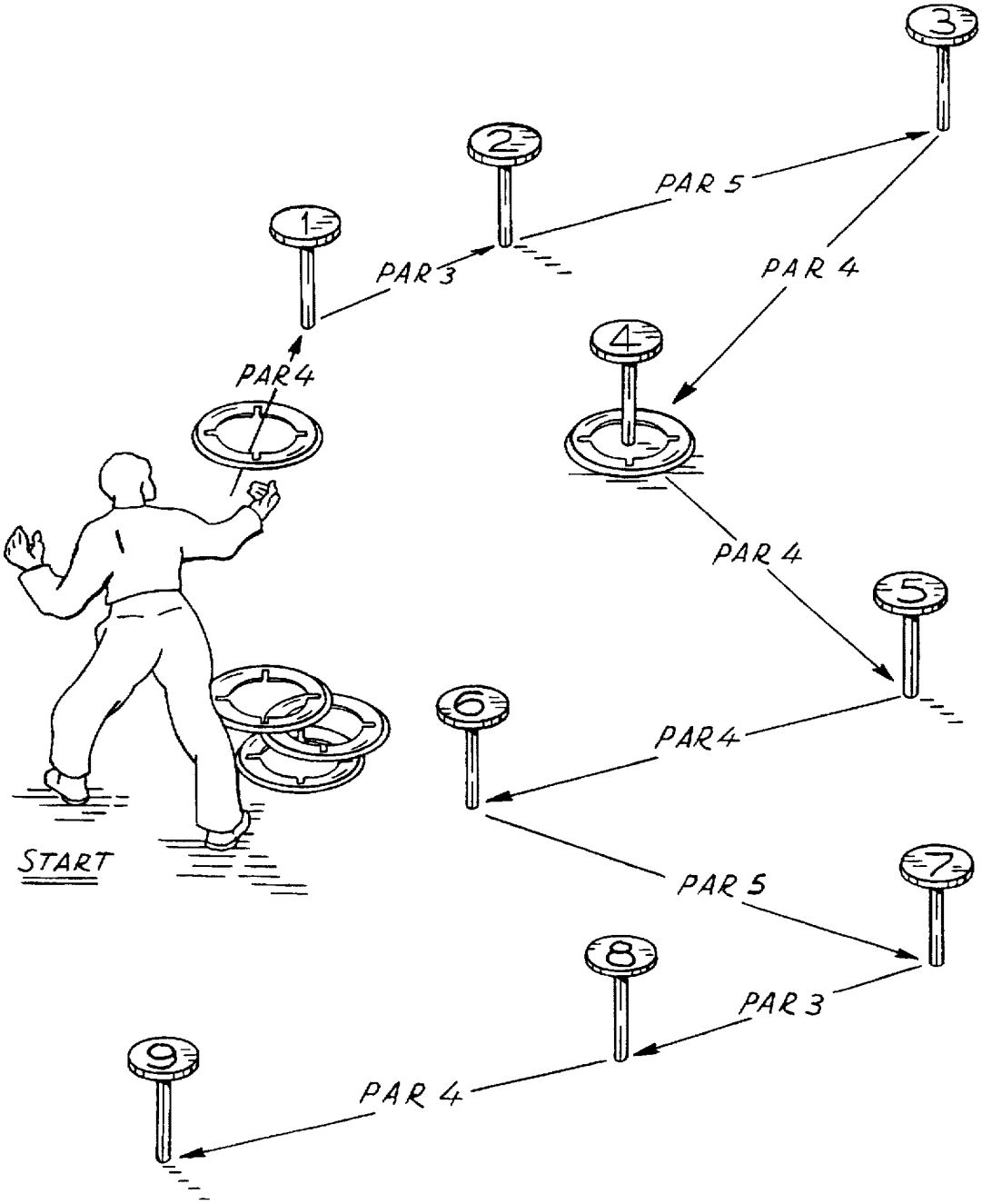
FIG. 4 depicts a yard game employing the ring and pegged targets.

The accuracy with which the disclosed ring can be thrown call also be used to advantage in playing games of skill such as variations of horseshoes and ring-toss golf as depicted in FIG. 4. It is to be expected that even semi-skilled ring tossers will be able to "flick" a disc constructed according to this disclosure with sufficient accuracy to permit encircling targets having point values commensurate with the degree of perceived difficulty.

While the foregoing is a complete and detailed description of the preferred embodiments of the disclosed ring, numerous variations and modifications may also be employed to implement the purpose of the invention. And, therefore, the elaboration provided should not be assumed to limit the scope of the invention which is intended to be defined by the appended claims.

What I claim is:

1. A toy ring for throwing, capable of demonstrating enhanced accuracy in flight, molded to comprise:

a perimeter, structurally augmented and generally annular in shape; and a plurality of flaps, flexibly hinged to and extending medially from said perimeter, each flap having two sides formed by radial cuts, and the distal ends of said flaps defining a central orifice around which said flaps will flex vertically in direct response to air movement during flight.

2. A toy ring according to claim 1 wherein the perimeter is structurally augmented by a plurality of molded annulations.

3. The molded annulations according to claim 2 which are dimensionally reduced from the outer to the innermost annulation.

4. A toy ring according to claim 1 wherein the flaps are approximately equal in shape and size.

* * * * *